US008676081B2

(12) United States Patent
Yamashita et al.

(10) Patent No.: US 8,676,081 B2
(45) Date of Patent: Mar. 18, 2014

(54) DEVELOPMENT APPARATUS AND IMAGE FORMING APPARATUS HAVING THE SAME

(75) Inventors: Kazuya Yamashita, Osaka (JP); Koji Izumi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 172 days.

(21) Appl. No.: 13/157,361

(22) Filed: Jun. 10, 2011

(65) Prior Publication Data

US 2011/0311261 A1 Dec. 22, 2011

(30) Foreign Application Priority Data

Jun. 17, 2010 (JP) ..... 2010-138289
Jun. 17, 2010 (JP) ..... 2010-138301

(51) Int. Cl.
*G03G 21/20* (2006.01)

(52) U.S. Cl.
USPC ..... 399/92

(58) Field of Classification Search
USPC ..... 399/92
See application file for complete search history.

(56) References Cited

U.S. PATENT DOCUMENTS

2001/0026707 A1* 10/2001 Miyabe et al. ..... 399/111
2008/0063425 A1* 3/2008 Idehara et al. ..... 399/93

FOREIGN PATENT DOCUMENTS

JP 2005-215655 8/2005
JP 2007-226148 9/2007
JP 2008-268529 11/2008
JP 2009-288708 A 12/2009

* cited by examiner

*Primary Examiner* — Walter L Lindsay, Jr.
*Assistant Examiner* — Barnabas Fekete
(74) *Attorney, Agent, or Firm* — Smith, Gambrell & Russell, LLP

(57) ABSTRACT

A development apparatus according to the present invention includes: a stir member that stirs a developer in a development container; a stir gear that rotates the stir member; a stir rotation shaft that connects the stir member and the stir gear to each other; a development member that supplies the developer onto a surface of an image carrier; a development gear that collaborates with the stir gear to form a series of gears and rotates the development member; a development rotation shaft that connects the development member and the development gear to each other; a housing box that houses the stir gear and the development gear, supports the stir rotation shaft and the development rotation shaft, and is provided with an air take-in opening for taking in air and an air discharge opening for discharging the taken-in air; and a wind sending member that takes in the air from the air take-in opening into the housing box and makes the taken-in air pass through the housing box to discharge the air from the air discharge opening.

12 Claims, 9 Drawing Sheets

DEVELOPMENT APPARATUS AND IMAGE FORMING APPARATUS HAVING THE SAME

This application is based on Japanese Patent Application No. 2010-138289 filed on Jun. 17, 2010 and Japanese Patent Application No. 2010-138301 filed on Jun. 17, 2010, the contents of which are hereby incorporated by reference.

BACKGROUND OF THE INVENTION

1. Field of the Invention

The present invention relates to a development apparatus used for image forming apparatuses such as a copy machine, a printer, a facsimile, a multi-functional machine of them and the like that use an electro-photographic system and to an image forming apparatus that includes the development apparatus, more particularly, to a development apparatus that is able to cool a drive portion; and an image forming apparatus that includes the development apparatus.

2. Description of the Related Art

In image forming apparatuses such as a copy machine, a printer and the like, developers are stirred by a stir member in a developer container that stores the developers; the stirred developers are carried from the stir member to a development member; and the developers carried on the development member are formed into a thin layer by a blade; thereafter, the developers are supplied to an image carrier. As described above, in a development process in which a electrostatic latent image on the image carrier is formed into a visible image, heat is generated by friction between the developers due to the stirring, friction due to contact between the developers and the blade, and further slide friction due to the rotation driving of the stir member and the development member and the like, so that the temperature of the development apparatus increases If the temperature of the development apparatus increases, the developers increase in temperature and are likely to deteriorate in performance; besides, fluidity of the developers deteriorate in the developer container and the developers are attracted to the blade and the development member, so that there is a risk that uneven development occurs and the development performance deteriorates.

As a measure against this, for example, there is a development apparatus in which a plurality of cooling fans are formed on a bottom surface of a development container that stores developers; and a heat sink is composed of the cooling fans. According to such a development apparatus, heat in the development container generated by the stirring of the developers and the contact between the developers and the blade is radiated by the heat sink to outside of the development apparatus.

As causes of the temperature increase of the development apparatus, besides the stirring of the developers in the development apparatus and the contact between the developers and the blade, there are the slide friction between the rotation shafts of the stir member and development member and their bearings, and the friction and the like of drive portions such as the friction of drive gears for rotating the stir member and development member, which generate heat. In recent years, because of high-speed image forming apparatuses, the rotation speed of the stir member and the development member becomes high, and the heat generation at their drive portions further increases the temperature of the development apparatus. However, in the above development apparatus, it is hard to curb the temperature increase due to the heat generation at the drive members of the development member and the stir member.

SUMMARY OF THE INVENTION

It is an object of the present invention to provide: a development apparatus that curbs temperature increase of a developer; and an image forming apparatus that uses the development apparatus.

A development apparatus according to a first aspect of the present invention includes: a stir member that stirs a developer in a development container; a stir gear that rotates the stir member; a stir rotation shaft that connects the stir member and the stir gear to each other; a development member that supplies the developer onto a surface of an image carrier; a development gear that collaborates with the stir gear to form a series of gears and rotates the development member; a development rotation shaft that connects the development member and the development gear to each other; a housing box that houses the stir gear and the development gear, rotatably supports the stir rotation shaft and the development rotation shaft, and is provided with an air take-in opening for taking in air and an air discharge opening for discharging the taken-in air; and a wind sending member that takes in the air from the air take-in opening into the housing box and makes the taken-in air pass through the housing box to discharge the air from the air discharge opening.

Other objects of the present invention and specific advantages obtained by the present invention are will be more apparent from description of embodiments described hereinafter.

DESCRIPTION OF THE PREFERRED EMBODIMENTS

Hereinafter, embodiments of the present invention are described with reference to the drawings; however, the present invention is not limited to the embodiments. Besides, applications and terms and the like described here are not limited to the embodiments.

First Embodiment

Figure 1:
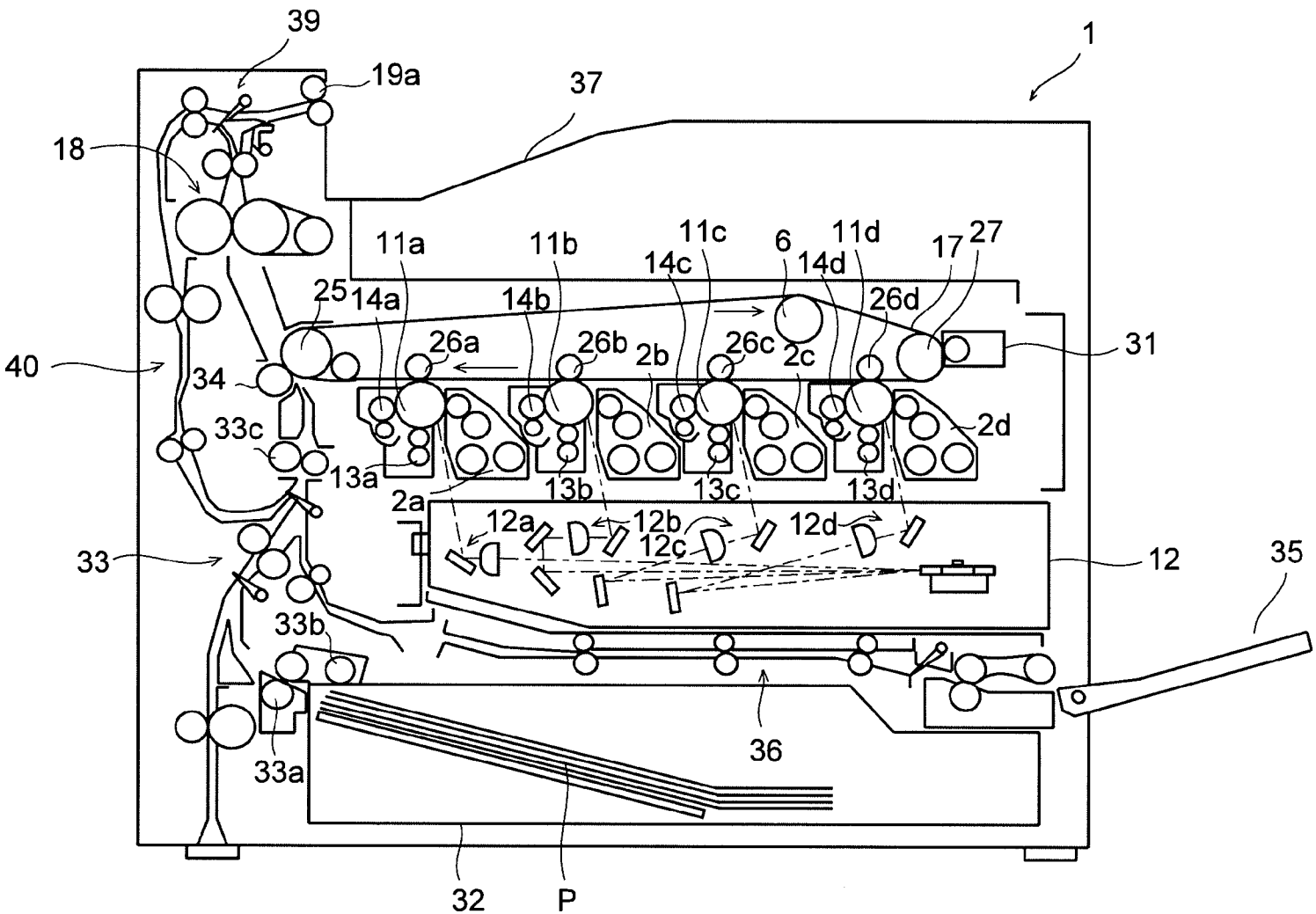
FIG. 1 is a view showing schematically an image forming apparatus that includes a development apparatus according to a first embodiment of the present invention.

FIG. 1 is a view showing schematically an image forming apparatus that includes a development apparatus according to a first embodiment of the present invention. An image forming apparatus 1 is of a tandem type of color printer in which as rotatable photoreceptors 11*a* to 11*d*, organic photoreceptors (OPC photoreceptor) are used as photosensitive materials for forming a photosensitive layer; and are disposed corresponding to the respective colors of black, yellow, cyan and magenta. Around the respective photoreceptors 11*a* to 11*d*, development apparatuses 2*a* to 2*d*, an exposure unit 12, electrifiers 13*a* to 13*d* and cleaning apparatuses 14*a* to 14*d* are disposed.

The development apparatuses 2*a* to 2*d* are so disposed on the right side as to face the photoreceptors 11*a* to 11*d*, respectively; and supply toner to the photoreceptors 11*a* to 11*d*. The electrifiers 13*a* to 13*d* are so disposed as to face surfaces of the photoreceptors 11*a* to 11*d* on upstream sides in rotation directions of the photoreceptors with respect to the development apparatuses 2*a* to 2*d*; and evenly electrify the surfaces of the photoreceptors 11*a* to 11*d*.

The exposure unit 12, based on image data such as a letter, an icon and the like which are input into an image input portion (not shown) from a personal computer and the like, scans each of the photoreceptors 11*a* to 11*d* for exposure; and is disposed under the development apparatuses 2*a* to 2*d*. The exposure unit 12 is provided with a laser light source, a polygonal mirror, a reflection mirror and a lens corresponding to each of the photoreceptors 11*a* to 11*d*. Laser light emitted from the laser light source is shined onto the surfaces of the respective photoreceptors 11*a* to 11*d* from downstream sides in the rotation directions of the photoreceptors with respect to the electrifiers 13*a* to 13*d* via the reflected mirror and the lens. By the shined laser light, electrostatic latent images are formed on the surfaces of the respective photoreceptors 11*a* to 11*d*; and the electrostatic latent images are developed into toner images by the development apparatuses 2*a* to 2*d*.

An endless intermediate transfer belt 17 is mounted on a tension roller 6, a drive roller 25, and a driven roller 27. The drive roller 25 is driven to rotate by a not-shown motor; the intermediate transfer belt 17 is driven circularly by the rotation of the drive roller 25.

Each of the photoreceptors 11*a* to 11*d* is so disposed under the intermediate transfer belt 17 along a carry direction (arrow direction in FIG. 1) as to come into contact with the intermediate transfer belt 17. Each of primary transfer rollers 26*a* to 26*d* faces each of the photoreceptors 11*a* to 11*d* via the intermediate transfer belt 17 and comes into tight contact with the intermediate transfer belt 17 to form a primary transfer portion. At this primary transfer portion, the toner images on the respective photoreceptors 11*a* to 11*d* are successively transferred onto the intermediate transfer belt 17 at predetermined timing in response to the rotation of the intermediate transfer belt 17. In this way, a toner image with the toner images of cyan, magenta, yellow and black overlapped with each other is formed on the surface of the intermediate transfer belt 17.

A secondary transfer roller 34 faces the drive roller 25 via the intermediate transfer belt 17 and comes into tight contact with the intermediate transfer belt 17 to form a secondary transfer portion. At this second transfer portion, the toner image on the surface of the intermediate transfer belt 17 is transferred onto a paper sheet P. After the transfer, a belt cleaning apparatus 31 sweeps away toners remaining on the intermediate transfer belt 17.

In a lower portion of the image forming apparatus 1, a paper-sheet supply cassette 32 for storing the paper sheets P is disposed; and on the right side of the paper-sheet supply cassette 32, a stack tray 35 for manually supplying paper sheets is disposed. On the left side of the paper-sheet supply cassette 32, a first paper-sheet carry path 33 is so disposed as to carry the paper sheet P carried from the paper-sheet supply cassette 32 to the secondary transfer portion of the intermediate transfer belt 17. Besides, on the left side of the stack tray 35, a second paper-sheet carry path 36 is so disposed as to carry a paper sheet carried from the stack tray 35 to the secondary transfer portion. Further, at an upper left portion in the image forming apparatus 1, a fixing portion 18 is so disposed as to apply a fixing process to the paper sheet P on which the image is formed; and a third paper-sheet carry path 39 is so disposed as to carry the paper sheet after the fixing process to a paper-sheet ejection portion 37.

The paper-sheet supply cassette 32 is pulled out to outside (front side of the paper surface of FIG. 1) of the apparatus to allow the supply of paper sheets; the stored paper sheets P are carried one after another to the first paper-sheet carry path 33 by a pick-up roller 33*b* and a separation roller 33*a*.

The first paper-sheet carry path 33 and the second paper-sheet carry path 36 join with each other before a resist roller 33*c*; the paper sheet P is carried to the secondary transfer portion in synchronization with the timing of the image forming operation of the intermediate transfer belt 17 and the paper-sheet carry operation. Onto the paper sheet P carried to the secondary transfer portion, the toner image on the intermediate transfer belt 17 is secondarily transferred by the secondary transfer roller 34 to which a bias potential is applied, and the paper sheet P is carried to the fixing portion 18.

The fixing portion 18 includes: a fixing belt that is heated by a heater; a fixing roller that internally comes into contact with the fixing belt; and a pressure roller that comes into tight contact with the fixing roller via the fixing belt and the like; heats and pressurizes the paper sheet P on which the toner image is transferred, thereby performing the fixing process. After the toner image is fixed by the fixing portion 18, the paper sheet P is turned upside down by a fourth paper-sheet carry path 40 if necessary; and the toner image is secondarily transferred onto a rear side as well of the paper sheet P by the secondary transfer roller 34 and is fixed by the fixing portion 18. The paper sheet P on which the toner image is fixed passes through a third paper-sheet path 39 and is carried to the paper-sheet ejection portion 37 by an ejection roller 19*a*.

Figure 2:
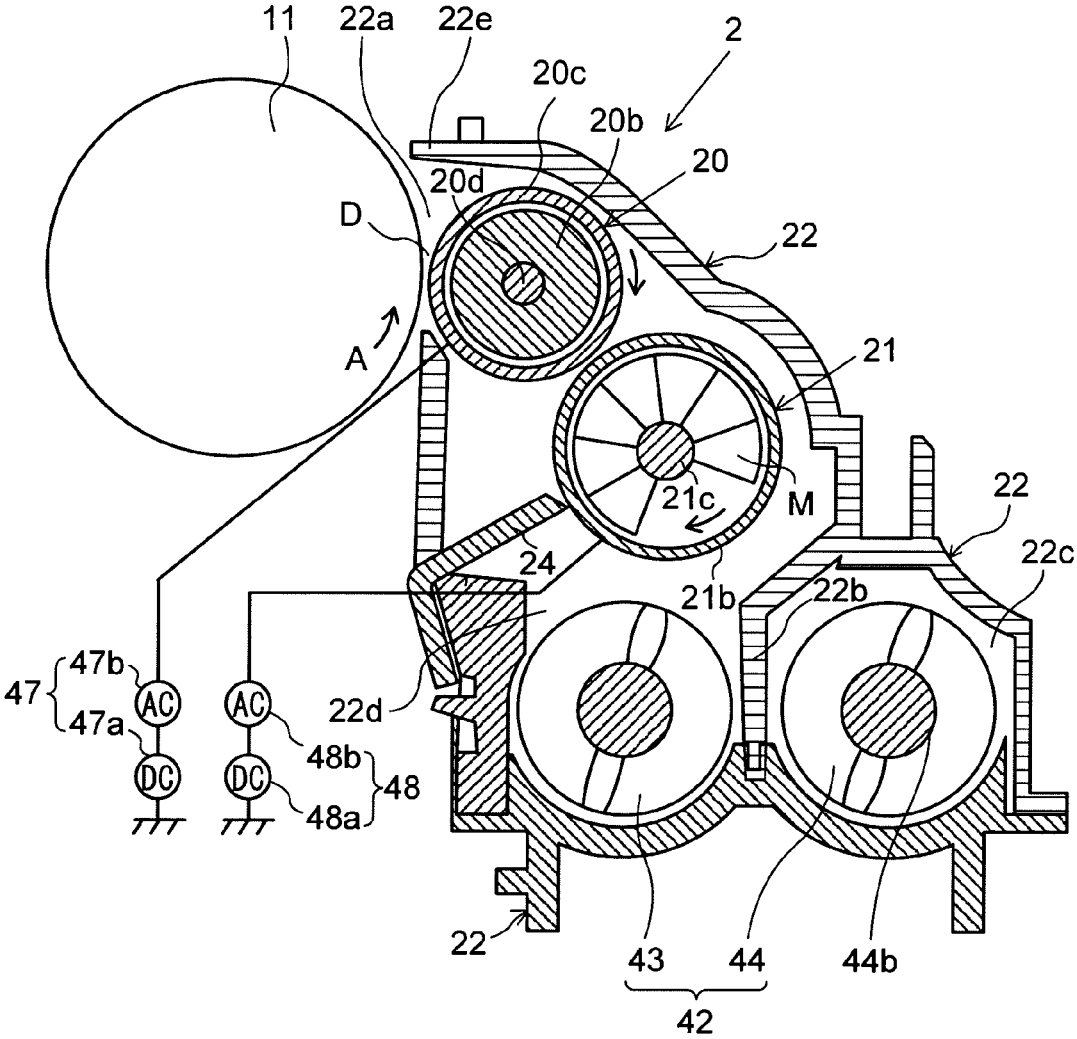
FIG. 2 is a sectional view showing schematically the development apparatus according to the first embodiment of the present invention.

FIG. 2 is a sectional view showing the development apparatus used in the above image forming apparatus 1. Here, in the following description, a structure and operation of the development apparatus 2*a* corresponding to the photoreceptor 11*a* shown in FIG. 1 are described; because structures and operations of the development apparatuses 2*b* to 2*d* are the same as the development apparatus 2*a*, description of them is skipped; and the signs a to d for indicating the development apparatuses and photoreceptors for the respective colors are omitted.

The development apparatus 2 is composed of: a development roller 20; a magnetic roller 21; a limit blade 24; a stir member 42; a development container 22 and the like.

The development container 22 constitutes an outer frame of the development apparatus 2 and is partitioned at a lower portion into a first carry path 22*d* and a second carry path 22*c* by a partition portion 22*b*. In the first carry path 22*d* and the second carry path 22*c*, developers including carriers and toners are stored. Besides, the developer container 22 holds: the stir member 42; the development roller 20; and the magnetic roller 21. Further, the development container 22 is provided with an opening 22*a* for exposing the development roller 20 to the photoreceptor 11.

The development roller 20 faces the photoreceptor 11 and is disposed to the right of the photoreceptor 11 over a predetermined distance. Besides, the development roller 20 forms, at a position that is near and faces the photoreceptor 11, a development region D where toners are supplied to the photoreceptor 11. The magnetic roller 21 faces the development roller 20 over a predetermined distance and is disposed at a diagonally right position below the development roller 20. Besides, the magnetic roller 21 supplies toners to the development roller 20 at a position near the development roller 20. The stir member 42 is disposed substantially under the magnetic roller 21. Besides, the limit blade 24 is fixed to and held by the development container 22 at a diagonally left position below the magnetic roller 21.

The stir member 42 is composed of two spirals, that is, a first spiral 43 and a second spiral 44. The first spiral 43 is disposed in the first carry path 22*d* under the magnetic roller 21; the second spiral 44 is disposed at a position that is in the second carry path 22*c* and adjacent to the right side of the first spiral 43.

The first and second spirals 43, 44 are rotated by a drive mechanism composed of a motor and a gear described later and by means of the rotations, stir the developers and electrify the toners in the developers to a predetermined level. In this way, the toners are held by the carriers. Besides, communication portions (not shown) are disposed through both end portions in a longitudinal direction (front-to-rear surface direction of the paper sheet of FIG. 2) of the partition portion 22*b* that partitions the first carry path 22*d* and the second carry path 22*c*; when the second spiral 44 rotates, the electrified developers are carried from one communication portion formed through the partition portion 22*b* to the first spiral 43, so that the developers circulate in the first carry path 22*d* and the second carry path 22*c*. And, the developers are supplied from the first spiral 43 to the magnetic roller 21.

The magnetic roller 21 includes: a stationary shaft 21*c*; a magnetic pole member M; and a rotation sleeve 21*b* that is composed of a non-magnetic metal material into a cylindrical shape; carries the developers that are stirred by the stir member 42; and supplies only the toners of the carried developers to the development roller 20. In the magnetic pole portion M, a plurality of magnets, which are formed into fan shapes in section and have different polarities on the circumferential portions, are disposed in a predetermined order and fixed to the stationary shaft 21*c* by adhesion and the like. The stationary shaft 21*c*, in the rotation sleeve 21*b*, is supported by the development container 22 in a not-to-rotate manner with a predetermined distance formed between the magnetic pole member M and the rotation sleeve 21*b*. The rotation sleeve 21*b* is rotated in the same direction (clockwise direction in FIG. 2) as the development roller 20 by a drive mechanism that is composed of a motor and a gear described later; and a bias 48 with an alternating-current voltage 48*b* superposed on a direct-current voltage 48*a* is applied to the rotation sleeve 21*b*. On a surface of the rotation sleeve 21*b*, the electrified developers are formed into a magnetic brush by magnetic force of the magnetic pole member M and carried; the magnetic brush is adjusted to a predetermined height by the limit blade 24.

When the rotation sleeve 21 rotates, the magnetic brush is held and carried on the surface of the rotation sleeve 21*b* by the magnetic pole member M; when the magnetic brush comes into contact with the development roller 20, only the toners of the magnetic brush are supplied to the development roller 20 in accordance with the bias 48 applied to the rotation sleeve 21*b*.

The development roller 20 is so composed as to include: a magnetic pole member 20*b*; a development sleeve 20*c* that is composed of a non-magnetic metal material into a cylindrical shape; a stationary shaft 20*d* and the like.

The stationary shaft 20*d* is supported by the development container 22 in a not-to-rotate manner. On this stationary shaft 20*d*, the magnetic pole member 20*b* formed of a magnet is fixed by adhesion and the like a predetermined distance away from the development sleeve 20*c* that faces the magnetic roller 21; further, the development sleeve 20*c* is rotatably held. The development sleeve 20*c* is rotated in an arrow direction (clockwise direction) in FIG. 2 by a drive mechanism that is composed of a motor and a gear described later. Besides, a development bias 47 with an alternating-current voltage 47*b* superposed on a direct-current voltage 47*a* is applied to the development sleeve 20*c*.

When the development sleeve 20*c* rotates in the clockwise direction in FIG. 2, the toners are held by the development sleeve 20*c* and carried to the development region D; thanks to a potential difference between a development bias potential and an electric potential at an exposure portion of the photoreceptor 11, the toners held on the surface of the development sleeve 20*c* fly to the photoreceptor 11 at the development region D. The flying toners are successively attracted to the exposure portion on the photoreceptor 11 that rotates in an arrow A direction (counterclockwise direction); and an electrostatic latent image is developed on the photoreceptor 11.

Figure 3:
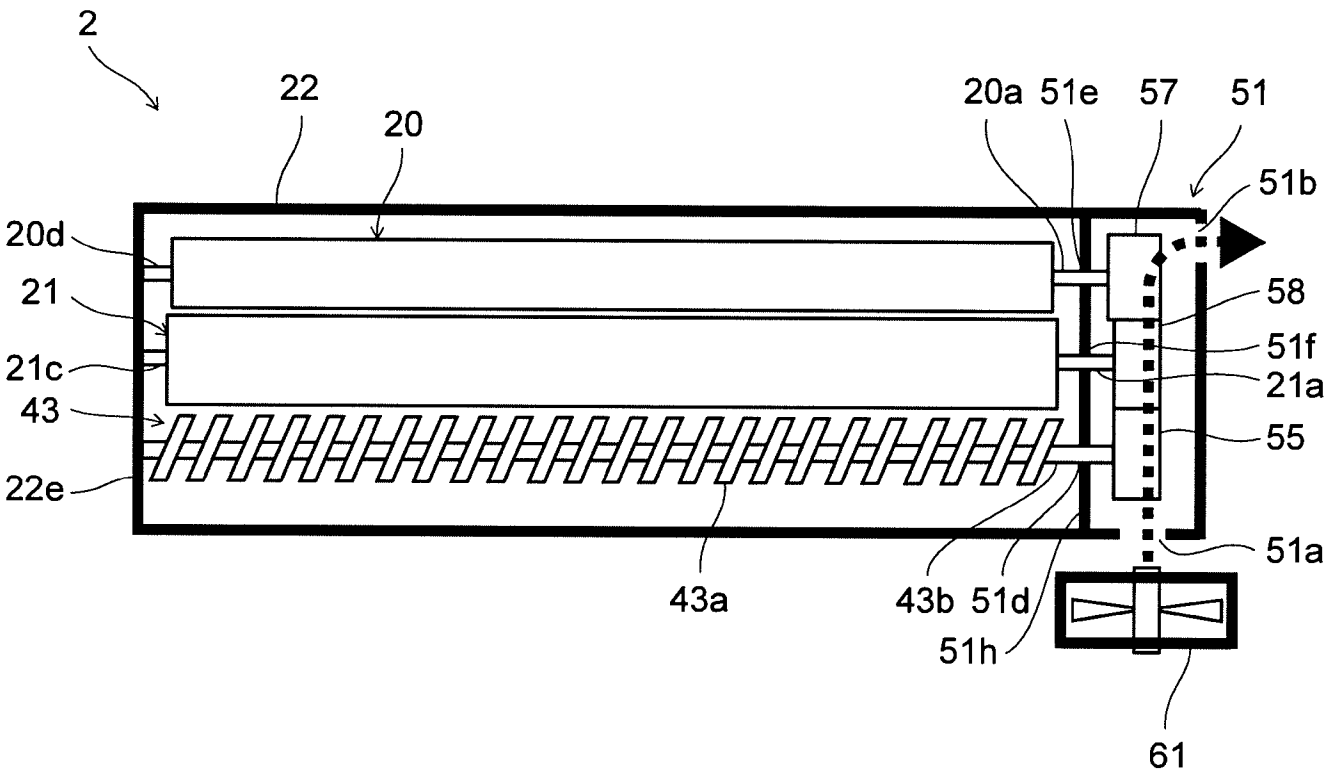
FIG. 3 is a plan view showing schematically the development apparatus according to the first embodiment of the present invention.
Figure 4:
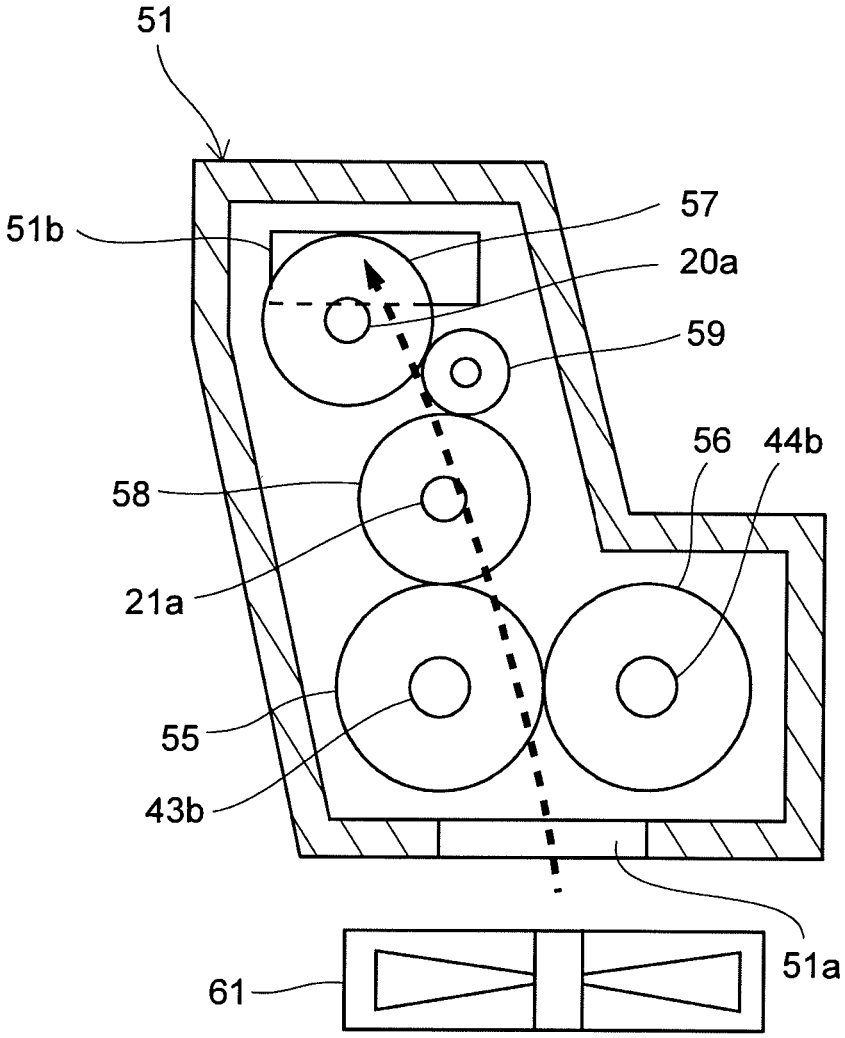
FIG. 4 is a side sectional view showing schematically a housing box according to the first embodiment of the present invention.

Next, drive mechanisms, which drive to rotate the stir member 42, the development roller 20 that is a development member and the magnetic roller 21, are described based on FIG. 3 and FIG. 4. FIG. 3 is a plan view showing schematically the development apparatus; FIG. 4 is a side sectional view showing schematically a housing box of the development apparatus.

As shown in FIG. 3, in the development container 22, the first and second spirals 43, 44 (stir member 42, see FIG. 2), the development roller 20 and the magnetic roller 21 are disposed; on one side surface of the development container 22, a housing box 51 for housing a plurality of drive gears 55 to 58 (also see FIG. 4) is disposed; further, near the housing box 51, an air take-in fan 61 that is a wind sending member is disposed.

The first spiral 43 includes: a first rotation shaft 43*b* that is a stir rotation shaft; and a first spiral blade 43*a* that is integrally formed with the first rotation shaft 43*b* and spirally formed in a shaft direction of the first rotation shaft 43 at a predetermined pitch. Besides, the first rotation shaft 43*b* extends to both ends in a longitudinal direction (shaft direction of the first rotation shaft 43*b*) of the development container 22; one end of the first rotation shaft 43*b* is rotatably supported by a side wall 22*e* of the development container 22, while the other end of the first rotation shaft 43*b* is rotatably supported by a first bearing portion 51*d* that is formed through a side wall 51*h* of the housing box 51. The other end of the first rotation shaft 43*b* further extends; and a first drive gear 55 including a spur gear is fixed on the first rotation shaft 43*b*. Accordingly, when the first drive gear 55 rotates, the first spiral 43 rotates together with the first rotation shaft 43*b*.

The second spiral 44 (see FIG. 2) includes a second rotation shaft 44*b* (see FIG. 2) that is a stir rotation shaft; the second rotation shaft 44*b*, like the first spiral 43, although not shown, includes a spiral blade which is integrally formed with the second rotation shaft 44*b*; further the second rotation shaft 44*b* is rotatably supported by the side wall 22*e* of the development container 22 and the side wall 51*h* of the housing box 51. On one end of the second rotation shaft 44*b*, a second drive gear 56 (see FIG. 4) including a spur gear is fixed; when the second drive gear 56 rotates, the second spiral 44 rotates together with the second rotation shaft 44*b*. The second drive gear 56 is housed in the housing box 51 (see FIG. 4).

As described above, the stationary shaft 20*d* of the development roller 20 is supported in a not-to-rotate manner by the side wall 22*e* of the development container 22. On the other end of the development roller 20, a third rotation shaft 20*a* as a development rotation shaft is disposed. The third rotation shaft 20*a* of the development roller 20 is rotatably supported by a third bearing portion 51*e* that is formed through the side wall 51*h* of the housing box 51; and extends into the development roller 20 to be supported rotatably and concentrically by the stationary shaft 20*d*. Further, the third rotation shaft 20*a* extends into the housing box 51; and on the third rotation shaft 20*a*, a third drive gear 57 including a spur gear is fixed. Accordingly, when the third drive gear 57 rotates, the development roller 20 (development sleeve 20*c*, see FIG. 2) rotates together with the third rotation shaft 20*a*.

Besides, the stationary shaft 21*c* of the magnetic roller 21 is supported in a not-to-rotate manner by the side wall 22*e* of the development container 22. On the other end of the magnetic roller 21, a fourth rotation shaft 21*a* as a development rotation shaft is disposed. The fourth rotation shaft 21*a* of the magnetic roller 21 is rotatably supported by a fourth bearing portion 51*f* that is formed through the side wall 51*h* of the housing box 51; and extends into the magnetic roller 21 to be supported rotatably and concentrically by the stationary shaft 21*c*. Further, the fourth rotation shaft 21*a* extends into the housing box 51; and on the fourth rotation shaft 21*a*, a fourth drive gear 58 including a spur gear is fixed. Accordingly, when the fourth drive gear 58 rotates, the magnetic roller 21 (development sleeve 21*b*, see FIG. 2) rotates together with the fourth rotation shaft 21*a*.

As shown in FIG. 4, the first drive gear 55 and the second drive gear 56 mesh with each other to constitute a stir gear; besides, the third drive gear 57 and the fourth drive gear 58 mesh with each other via an idle gear 59 to constitute a development gear. The idle gear 59 is rotatably supported in the housing box 51. And, the first drive gear 55 and the fourth drive gear 58 mesh with each other and the fourth drive gear 58 is rotated by a drive source such as a not-shown motor and the like. The motor is driven to rotate, the fourth drive gear 58 rotates, and the third drive gear 57 rotates via the idle gear 58; further, the first drive gear 55 is rotated by the fourth drive gear 58; further, the second drive gear 56 rotates. Because of these rotations, the first spiral 43 (see FIG. 2) rotates together with the first rotation shaft 43*b*, and the second spiral 44 (see FIG. 2) rotates together with the second rotation shaft 44*b*; further, the development roller 20 (see FIG. 2) rotates together with the third rotation shaft 20*a*, and the magnetic roller 21 (see FIG. 2) rotates together with the fourth rotation shaft 21*a*. Here, instead of connecting the motor to the fourth rotation gear 58, the motor may be connected to one of the other drive gears 55 to 57.

The first to fourth drive gears 55 to 58, and the first to fourth rotation shafts 20*a*, 21*a*, 43*b*, 44*b* each are formed of a highly heat-conductive material such as aluminum, copper, iron or an alloy including these metals. It is desirable that the idle gear 59 is also formed of a highly heat-conductive material.

The housing box 51 is formed of a resin into substantially an L-shape box; and in the inside of the box, the first to fourth drive gears 55 to 58, the idle gear 59, and the first to fourth rotation shafts 20*a*, 21*a*, 43*b* and 44*b* are housed. Further, the housing box 51 is provided with an air take-in opening 51*a* and an air discharge opening 51*b*.

The air take-in opening 51*a* is an opening that is formed through a bottom-surface portion of the housing box 51 and disposed at a position to face the mesh portion between the first drive gear 55 and the second drive gear 56. On the other hand, the air discharge opening 51*b* is an opening that is formed through a side-surface upper portion of the housing box 51 (also see FIG. 3) and disposed at a position to face a flat surface of the third drive gear 57.

An air take-in fan 61 is so disposed near the housing box 51 as to face the air take-in opening 51*a*. The air take-in fan 61 is an axial-flow fan (propeller fan), takes in relatively cold air around the development apparatus 2 and sends the air to the air take-in opening 51*a*. Accordingly, when the air take-in fan 61 operates, the air around the development apparatus 2 is taken from the air take-in opening 51*a* into the housing box 51. The air taken in from the air take-in opening 51*a* flows in a direction perpendicular to the first to fourth rotation shafts 20*a*, 21*a*, 43*b*, and 44*b*, specifically, through a flow path (broken-line arrow direction in FIG. 3, FIG. 4) that extends from the first drive gear 55 and the second drive gear 56, passes the fourth drive gear 58, further the third drive gear 57, and reaches the air discharge opening 51*b*. Here, the air take-in opening 51*a* may be so formed at a position as to face a lower-side teeth surface of the second drive gear 56. In this case as well, the air taken in from the air take-in opening 51*a* flows through the flow path represented by the broken-line arrow direction in FIG. 3 and FIG. 4.

Here, when the first and second spirals 43, 44, the development roller 20 and the magnetic roller 21 rotate to stir the developers and to supply the stirred developers to the photoreceptor 11 (see FIG. 2), heat is generated by slide friction between the first to fourth rotation shafts 20*a*, 21*a*, 43*b*, 44*b* and the bearing portions for the rotation shafts in the housing box 51. This heat at the bearing portions diffuses to the relatively highly heat-conductive first to fourth rotation shafts 20*a*, 21*a*, 43*b*, 44*b* and first to fourth drive gears 55 to 58; further, is radiated from the air discharge opening 51*b* together with the air that flows through the above flow path (broken-line arrow direction in FIG. 3, FIG. 4) in the housing box 51. Besides, because of the rotations of the first to fourth drive gears 55 to 58 and the idle gear 59, heat is generated by friction at the respective mesh portions as well of the gears; however, the heat at these portions diffuses to the entire bodies of the first to fourth drive gears 55 to 58 and the idle gear 59; further is radiated from the air discharge opening 51*b* together with the air that flows through the above flow path in the housing box 51.

Second Embodiment

Figure 5:
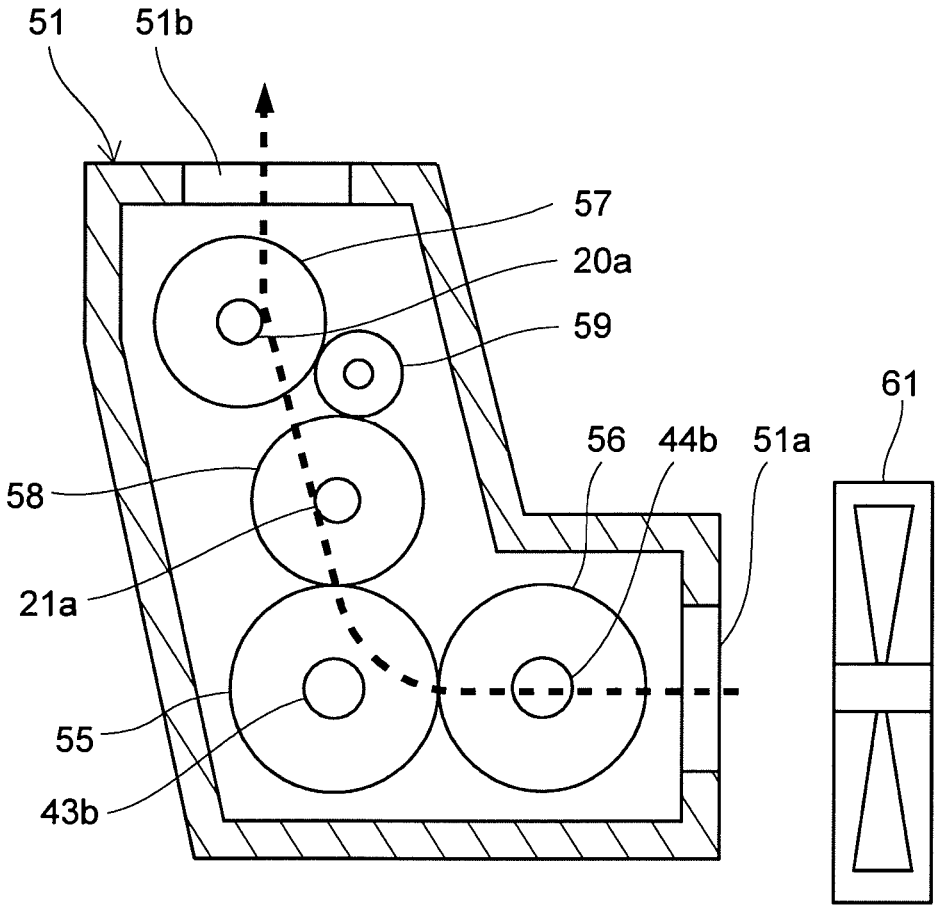
FIG. 5 is a side sectional view showing schematically a housing box according to a second embodiment of the present invention.

FIG. 5 is a side sectional view showing schematically a housing box according to a second embodiment. In the second embodiment, the air take-in opening 51*a* and the air discharge opening 51*b* that are different form the first embodiment are chiefly described hereinafter; and description of the same portions as the first embodiment is skipped.

The housing box 51 is formed of a resin into substantially an L-shape box; and in the inside of the box, the first to fourth drive gears 55 to 58, the idle gear 59, and the first to fourth rotation shafts 20*a*, 21*a*, 43*b* and 44*b* are housed. Further, the housing box 51 is provided with the air take-in opening 51*a* and the air discharge opening 51*b*.

The air take-in opening 51*a* is an opening that is formed through a side-surface portion (right side of FIG. 5) of the housing box 51 and disposed at a position to face a teeth surface of the second drive gear 56. On the other hand, the air discharge opening 51*b* is an opening that is formed through an upper-surface portion of the housing box 51 and disposed at a position to face a teeth surface of the third drive gear 57.

The air take-in fan 61 is so disposed near the housing box 51 as to face the air take-in opening 51*a*. The air take-in fan 61 takes in relatively cold air around the development apparatus 2 and sends the air to the air take-in opening 51*a*. Accordingly, when the air take-in fan 61 operates, the relatively cold air around the development apparatus 2 is taken in from the air take-in opening 51*a* into the housing box 51. The air taken in from the air take-in opening 51*a* flows in a direction perpendicular to the first to fourth rotation shafts 20*a*, 21*a*, 43*b*, and 44*b*, specifically, through a flow path (broken-line arrow direction in FIG. 5) that extends from the second drive gear 56 to the first drive gear 55, further from the fourth drive gear 58, passes the third drive gear 57, and reaches the air discharge opening 51*b*.

Here, when the first and second spirals 43, 44, the development roller 20 and the magnetic roller 21 rotate to stir the developers and to supply the stirred developers to the photoreceptor 11 (see FIG. 2), heat is generated by the slide friction between the first to fourth rotation shafts 20*a*, 21*a*, 43*b*, 44*b* and the bearing portions for the rotation shafts in the housing box 51. This heat at the bearing portions diffuses to the relatively highly heat-conductive first to fourth rotation shafts 20*a*, 21*a*, 43*b*, 44*b* and first to fourth drive gears 55 to 58; further, is radiated from the air discharge opening 51*b* together with the air that flows through the above flow path (broken-line arrow direction in FIG. 5) in the housing box 51. Besides, because of the rotations of the first to fourth drive gears 55 to 58, heat is generated at the respective mesh portions as well of the first to fourth drive gears 55 to 58; however, the heat at these portions diffuses to the entire bodies of the first to fourth drive gears 55 to 58 and the idle gear 59; further, is radiated from the air discharge opening 51*b* together with the air that flows through the above flow path in the housing box 51.

According to the first and second embodiments, the development apparatus 2 includes: the first spiral 43 that stirs the developers in the development container 22; the first drive gear 55 that rotates the first spiral 43; and the first rotation shaft 43*b* that connects to the first spiral 43 and to the first drive gear 55. Further, the development apparatus 2 includes: the development roller 20 that supplies the developers to the surface of the photoreceptor 11; the third drive gear 57 that collaborates with the first drive gear 55 to constitute a series of gears, and rotates the development roller 20; and the third rotation shaft 20*a* that connects the development roller 20 and the third drive gear 57 to each other. Further, the development apparatus 2 includes: the housing box 51 that houses the first and third drive gears 55, 57, rotatably supports the first and third rotation shafts 43*b*, 20*a*, and is provided with the air take-in opening 51*a* that takes in air and the air discharge opening 51*b* that discharges the taken-in air; and the air take-in fan 61 that takes air from the air take-in opening 51*a* into the housing box 51, makes the taken-in air pass through the housing box 51, and discharges the air from the air discharge opening 51*b*.

According to this structure, when the first spiral 43 and the development roller 20 rotate to stir the developers and to supply the developers to the photoreceptor 11, heat is generated by the slide friction at portions that support the rotations of the first and third rotation shafts 43*b*, 20*a*; and further, heat is generated by the friction at the respective mesh portions as well of the first and third drive gears 55, 57. However, because the cold air that is taken in by the air take-in fan 61 from outside of the development apparatus 2 flows in the housing box 51, the heat at those portions is radiated together with the air flow from the air discharge opening 51*b* of the housing box 51; and the first and third rotation shafts 43*b*, 20*a*, the first and third drive gears 55, 57 are cooled, so that it is possible to curb the temperature increase of the developers.

Besides, according to the above first and second embodiments, the air take-in fan 61 is disposed near the air take-in opening 51*a* of the housing box 51, so that it is possible to flow a large amount of air in the housing box 51; and it is possible to efficiently cool the first and third rotation shafts 43*b*, 20*a*, the first and third drive gears 55, 57.

Third Embodiment

Figure 6:
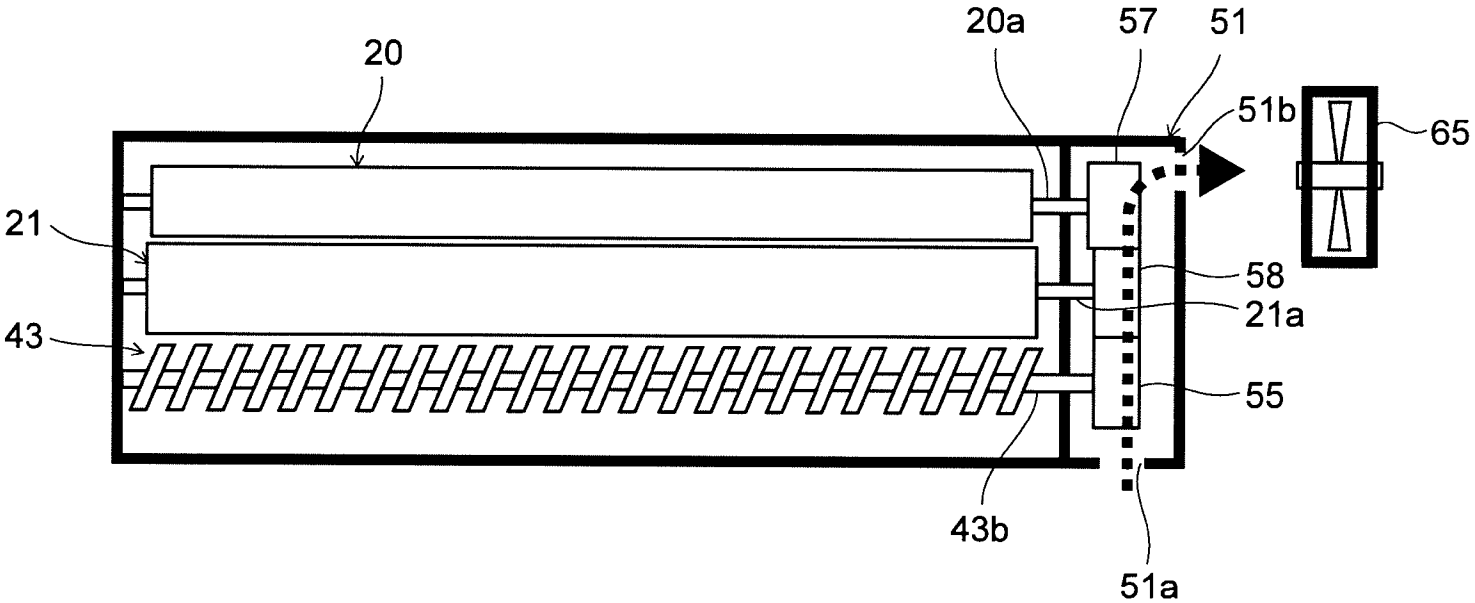
FIG. 6 is a plan view showing schematically a development apparatus according a third embodiment of the present invention.

FIG. 6 is a plan view showing schematically a development apparatus according a third embodiment. The third embodiment uses an air discharge fan as the wind sending member. In other words, the respective structures of the housing box 51, the air take-in opening 51*a*, and the air discharge opening 51*b* in the third embodiment are the same as the first embodiment; besides, the respective structures and materials of the first to fourth drive gears 55 to 58 and the first to fourth rotation shafts 20*a*, 21*a*, 43*b*, 44*b* are also the same as the first embodiment.

The air discharge fan 65 is an axial-flow fan (propeller fan) that sucks the air in the housing box 51 and discharges the air to the outside of the housing box 51; and is so disposed near the housing box 51 as to face the air discharge opening 51*b*. Accordingly, when the air discharge fan 65 operates, the relatively cold air around the development apparatus 2 is taken in from the air take-in opening 51*a* into the housing box 51; and flows through a flow path (broken-line arrow direction in FIG. 6) that extends from the first drive gear 55 and the second drive gear 56 (not shown) to the fourth drive gear 58, further passes the third drive gear 57, and reaches the air discharge opening 51*b*.

When the first and second spirals 43, 44, the development roller 20 and the magnetic roller 21 rotate to stir the developers and to supply the stirred developers to the photoreceptor 11, heat is generated by the slide friction between the first to fourth rotation shafts 20*a*, 21*a*, 43*b*, 44*b* and the bearing portions for the rotation shafts in the housing box 51. This heat at the bearing portions diffuses to the relatively highly heat-conductive first to fourth rotation shafts 20*a*, 21*a*, 43*b*, 44*b* and drive gears 55 to 58; further, is radiated from the air discharge opening 51*b* together with the air that flows through the above flow path (broken-line arrow direction in FIG. 6) in the housing box 51. Besides, because of the rotations of the first to fourth drive gears 55 to 58, heat is generated at the respective mesh portions as well of the first to fourth drive gears 55 to 58; however, the heat at these portions diffuses to the entire bodies of the first to fourth drive gears 55 to 58 and the idle gear 59; further, is radiated from the air discharge opening 51*b* together with the air that flows through the above flow path in the housing box 51.

According to the above third embodiment, the development apparatus 2 includes: the first spiral 43 that stirs the developers in the development container 22; the first drive gear 55 that rotates the first spiral 43; and the first rotation shaft 43*b* that connects to the first spiral 43 and to the first drive gear 55. Further, the development apparatus 2 includes: the development roller 20 that supplies the developers to the surface of the photoreceptor 11; the third drive gear 57 that collaborates with the first drive gear 55 to constitute a series of gears, and rotates the development roller 20; and the third rotation shaft 20*a* that connects the development roller 20 and the third drive gear 57 to each other. Further, the development apparatus 2 includes: the housing box 51 that houses the first and third drive gears 55, 57, rotatably supports the first and third rotation shafts 43*b*, 20*a*, and is provided with the air take-in opening 51*a* that takes in air and the air discharge opening 51*b* that discharges the taken-in air; and the air discharge fan 65 that takes in air from the air take-in opening 51*a* into the housing box 51, makes the taken-in air pass through the housing box 51, and discharges the air from the air discharge opening 51*b*.

According to this structure, when the first spiral 43 and the development roller 20 rotate to stir the developers and to supply the developers to the photoreceptor 11, heat is generated by the slide friction at the portions that support the rotations of the first and third rotation shafts 43*b*, 21*a*; and further, heat is generated by the friction at the respective mesh portions as well of the first and third drive gears 55, 57. However, because the cold air taken in from the outside of the development apparatus 2 flows in the housing box 51 thanks to the air discharge fan 65, the heat at those portions is radiated together with the air flow from the air discharge opening 51*b* of the housing box 51; and the first and third rotation shafts 43*b*, 20*a*, the first and third drive gears 55, 57 are cooled, so that it is possible to curb the temperature increase of the developers.

Besides, according to the above third embodiment, the air discharge fan 65 is disposed near the air discharge opening 51*b* of the housing box 51, so that it is possible to flow a large amount of air in the housing box 51; and it is possible to efficiently cool the first and third rotation shafts 43*b*, 20*a*, the first and third drive gears 55, 57.

Here, the air discharge fan 65 may be disposed near the air discharge opening 51*b* that is formed through the housing box 51 in the second embodiment.

Besides, in the above first and second embodiments, the structure in which the air take-in fan 61 is disposed is described; and in the third embodiment, the structure in which the air discharge fan 65 is disposed is described; however, the present invention is not limited to these: a structure in which both of the air take-in fan 61 and the aie discharge fan 65 are disposed may be employed. In this case as well, the same effects as the above embodiments are obtained.

Fourth Embodiment

Figure 7:
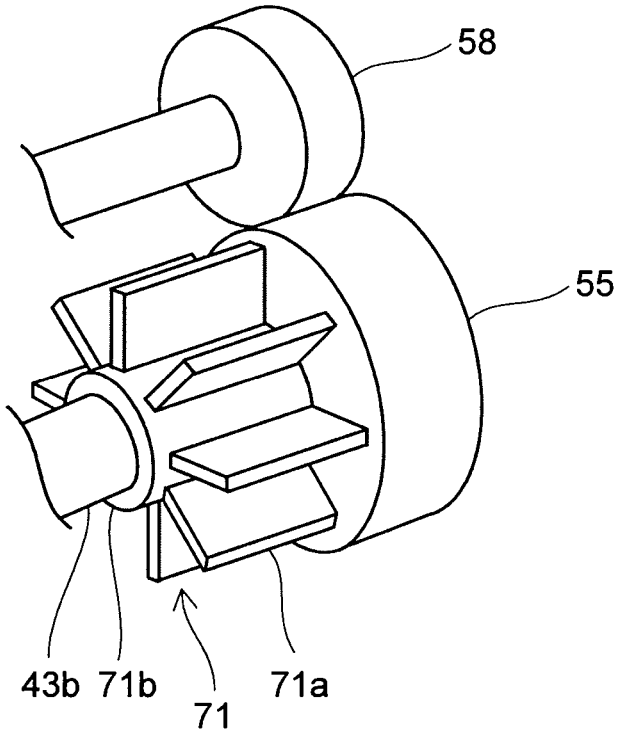
FIG. 7 is a perspective view showing a heat sink in a housing box according to a fourth embodiment of the present invention.

FIG. 7 is a perspective view showing a heat sink in a housing box according to a fourth embodiment. In the fourth embodiment, a heat sink 71 is disposed on the first drive shaft 43*b* in the first to third embodiments.

The heat sink 71 is formed of a highly heat-conductive material such as aluminum, copper, iron or an alloy including these metals and disposed between the first drive gear 55 and the first bearing portion 51*d* (see FIG. 3). Further, the heat sink 71 includes a plurality of fins 71*a* and a shaft portion 71*b*.

The shaft portion 71*b* is in contact with one flat surface of the first drive gear 55, is fitted onto the first rotation shaft 43*b* to be fixed. The plurality of fins 71*a* are formed about the shaft portion 71*b*. The plurality of fins 71*a* are in contact with the one flat surface of the first drive gear 55 and radially extend from the shaft portion 71*b*.

Because of the rotations of the first and fourth drive gears 55, 58 and the like, heat is generated by the friction at the mesh portion of the first drive gear 55 and at the slide portion between the first rotation shaft 43*b* and the bearing portion for the first rotation shaft 43*b*; this heat travels from the first drive gear 55 and the first rotation shaft 43*b* to the heat sink 71. On the heat sink 71, the plurality of fins 71*a* are formed; because the surface area of the heat sink 71 becomes large, the heat is efficiently radiated. The wind sending member (air take-in fan 61 or air discharge fan 65: see FIG. 3 or FIG. 6) and the heat sink 71 including the plurality of fins 71*a* rotate, so that the air flow is formed and the heat which travels to the heat sink 71 is radiated more efficiently from the heat sink 71 by the air flow. Accordingly, the heat generated at the rotation shafts and gears such as the first rotation shaft 43*b*, the first drive gear 55 and the like are somewhat discouraged from traveling into the inside of the development container 22 (see FIG. 3), so that it is possible to efficiently curb the temperature increase of the developers. Here, if the fin 71*a* and the bearing portion 71*b* are composed of the same material as the first drive gear 55, a low-cost production is possible. Besides, the fin 71*a* may be formed to be in contact with both flat surfaces of the first drive gear 55. Further, the fin 71*a* may be formed on other rotation shafts 20*a*, 20*b*, and 44*b*.

Fifth Embodiment

Figure 8:
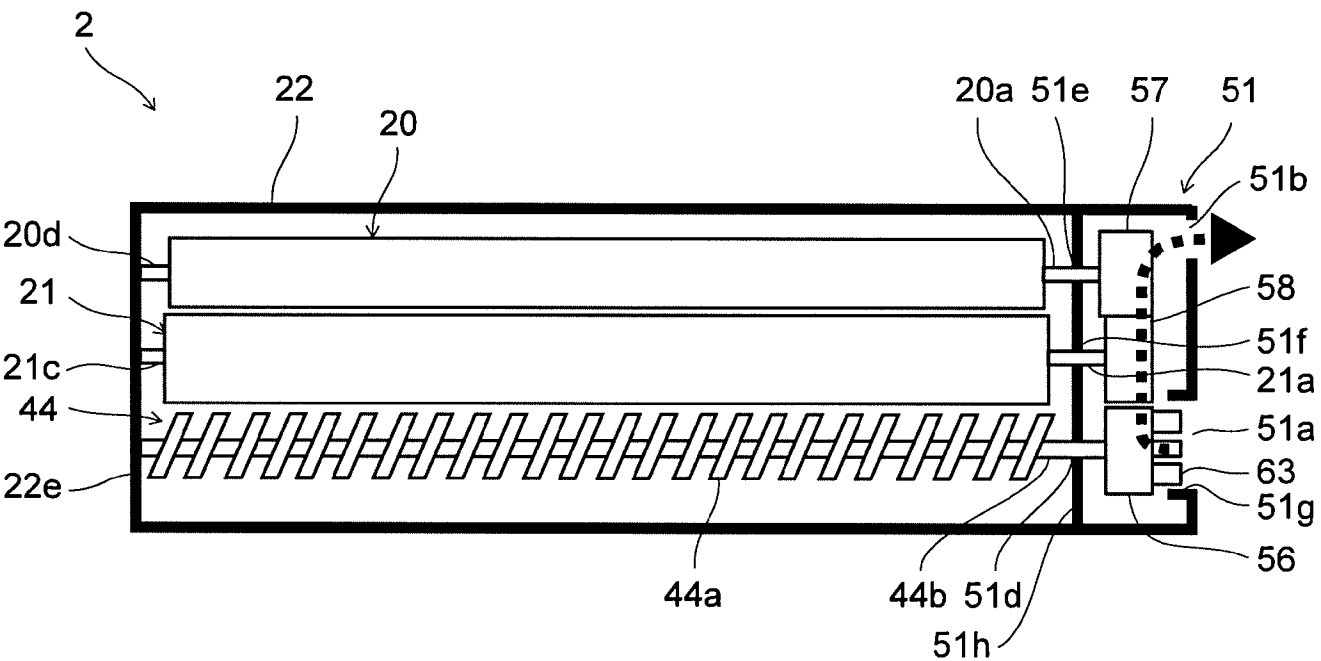
FIG. 8 is a plan view showing schematically a development apparatus according to a fifth embodiment of the present invention.
Figure 9:
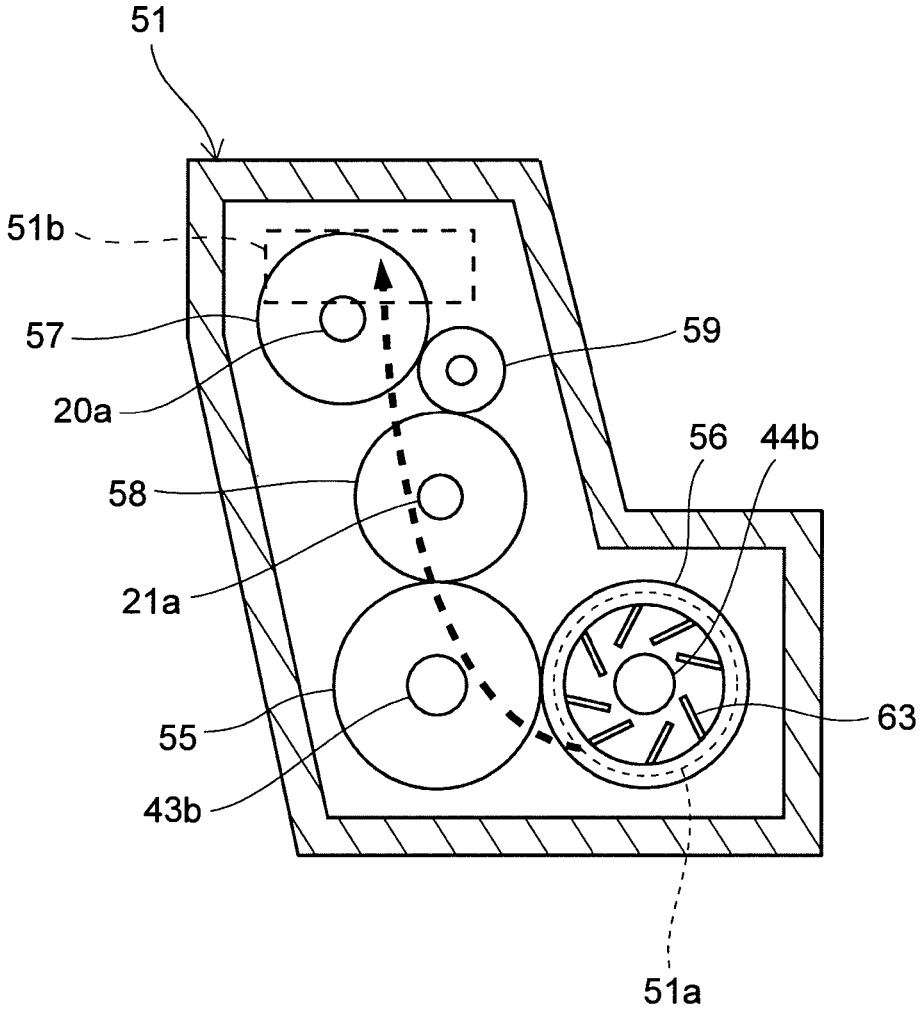
FIG. 9 is a side sectional view showing schematically a housing box according to the fifth embodiment of the present invention.

FIG. 8 is a plan view showing schematically a development apparatus according to a fifth embodiment; FIG. 9 is a side sectional view showing schematically a housing box according to the fifth embodiment. In the fifth embodiment, a structure of the wind sending member is different from those in the first to fourth embodiments.

As shown in FIG. 8, in the housing box 51, the first to fourth drive gears 55 to 58 (see FIG. 9) and a sirocco fan 63 as the wind sending member are disposed; further, the housing box 51 is provided with the air take-in opening and the air discharge opening 15*b*.

The air take-in opening 51*a* is formed through a side-surface lower portion of the housing box 51 as a circular opening, while the air discharge opening 51*b* is formed through a side-surface upper portion of the housing box 51 as a rectangular opening.

An opening edge of the of the ai take-in opening 51*a* is provided with a flange portion 51*g* that annularly protrudes into the inside of the housing box 51. And, the air take-in opening 51*a* faces the sirocco fan 63; the flange portion 51*g* of the air take-in opening 51*a* is so disposed as to overlap with part of the sirocco fan 63 in the shaft direction with a slight distance formed from an outer edge of the sirocco fan 63. On the other hand, the air discharge opening 51*b* is disposed at a position that faces a flat surface of the third drive gear 57 in the housing box 51.

The sirocco fan 63 is foxed to the second rotation shaft 44*b* and in contact with a flat surface of the second drive gear 56 on the air take-in opening 51*a* side. Besides, as shown in FIG. 9, the sirocco fan 6 includes a plurality of blades that are radially formed about the second rotation shaft 44*b* to be tilted with respect to a radial direction. Accordingly, when the second rotation shaft 44*b* rotates, the sirocco fan 63 takes in air from a center portion of the second rotation shaft 44*b* and flows the taken-in air to the outer edge side of the sirocco fan 63. Here, the plurality of blades of the sirocco fan 63, instead of being radially formed to be tilted with respect to the radial direction of the second rotation shaft 44*b*, may be radially formed in the radial direction of the second rotation shaft 44*b*. Besides, instead of the sirocco fan 63, the wind sending member may be composed of a fan such as a turbo fan and the like that flows the air in a circumferential direction of the second rotation shaft 44*b*.

Accordingly, when the sirocco fan 63 rotates, relatively cold air around the development apparatus 2 is taken in from the air take-in opening 51*a* into the housing box 51. The air taken in from the air take-in opening 51*a* flows from around the second drive gear 56 in a direction perpendicular to the first rotation shaft 43*b* to the first drive gear 55; further flows through a flow path (broken-line arrow direction in FIG. 8, FIG. 9) that extends from the fourth drive gear 58, passes the third drive gear 57, and reaches the air discharge opening 51*b*.

Here, when the first and second spirals 43, 44, the development roller 20 and the magnetic roller 21 rotate to stir the developers and to supply the stirred developers to the photoreceptor 11 (see FIG. 2), heat is generated by the slide friction between the first to fourth rotation shafts 20*a*, 21*a*, 43*b*, 44*b* and the bearing portions for the rotation shafts in the housing box 51. This heat at the bearing portions diffuses to the relatively highly heat-conductive first to fourth rotation shafts 20*a*, 21*a*, 43*b*, 44*b* and first to fourth drive gears 55 to 58; further, is radiated from the air discharge opening 51*b* together with the air that flows through the above flow path (broken-line arrow direction in FIG. 8, FIG. 9) in the housing box 51. Besides, because of the rotations of the first to fourth drive gears 55 to 58 and the idle gear 59, heat is generated by the friction at the respective mesh portions as well of the gears; however, the heat at these portions diffuses to the entire bodies of the first to fourth drive gears 55 to 58 and the idle gear 59; further, is radiated from the air discharge opening 51*b* together with the air that flows through the above flow path in the housing box 51.

According to the above fifth embodiment, the development apparatus 2 includes: the second spiral 44 that stirs the developers in the development container 22; the second drive gear 56 that rotates the second spiral 44; and the second rotation shaft 44*b* that connects to the second spiral 44 and to the second drive gear 56. Further, the development apparatus 2 includes: the development roller 20 that supplies the developers to the surface of the photoreceptor 11; the third drive gear 57 that collaborates with the second drive gear 56 to constitute a series of gears, and rotates the development roller 20; and the third rotation shaft 20*a* that connects the development roller 20 and the third drive gear 57 to each other. Further, the development apparatus 2 includes: the housing box 51 that houses the second and third drive gears 56, 57, rotatably supports the second and third rotation shafts 44*b*, 20*a*, and is provided with the air take-in opening 51*a* that takes in air and the air discharge opening 51*b* that discharges the taken-in air; and the sirocco fan 63 that is disposed on the second rotation shaft 44*b* in the housing box 51, takes in air from the air take-in opening 51*a* into the housing box 51, makes the taken-in air pass through the housing box 51, and discharges the air from the air discharge opening 51*b*.

According to this structure, when the first spiral 43 and the development roller 20 rotate to stir the developers and to supply the developers, heat is generated at the portions that support the rotations of the second and third rotation shafts 44*b*, 21*a*; and further, heat is generated at the respective mesh portions as well of the second and third drive gears 56, 57. However, because the cold air taken in from the outside of the development apparatus 2 flows in the housing box 51 thanks to the sirocco 63, the heat at those portions is radiated together with the air flow from the air discharge opening 51*b* of the housing box 51; and the second and third rotation shafts 44*b*, 20*a*, the second and third drive gears 56, 57 are cooled, so that it is possible to curb the temperature increase of the developers.

Besides, according to this structure, the wind sending member is composed of the sirocco fan 63, so that even if the sirocco fan 63 together with the second and third drive gears 56, 57 are housed in the housing box 51, there is no risk that the housing box 51 becomes large. Besides, the wind sending member (sirocco fan 65) is disposed in the housing box 15, so that there is no risk that the development apparatus 2 becomes large.

Besides, according to this structure, the sirocco fan 63 is disposed near the air take-in opening 51*a* of the housing box 51, so that it is possible to flow a large amount of air in the housing box 51; and it is possible to efficiently cool the second and third rotation shafts 44*b*, 20*a*, the second and third drive gears 56, 57.

Here, as in the above fifth embodiment, a structure may be employed, in which the sirocco fan 63 is formed on the second rotation shaft 44*b*; further, an axial-flow fan for air discharge such as a propeller fan and the like is formed on the third rotation shaft 20*a*; and the air discharge fan faces the air discharge opening 51*b*. In this case, the plurality of rotation shafts and the plurality of drive gears are more cooled, and it is possible to curb the temperature increase of the developers.

Besides, in the above fifth embodiment, the structure, in which the sirocco fan 63 is formed on the second rotation shaft 44*b* that is disposed near the air take-in opening 51*a*; and the sirocco fan 63 is so disposed as to face the air take-in opening 51*a*, is described; however, the present invention is not limited this: even if an axial-flow fan for taking in air such as a propeller fan and the like is structured in such a way that the second rotation shaft 44*b* faces the air take-in opening 51*a*, the plurality of rotation shafts and the plurality of drive gears are cooled, so that it is possible to curb the temperature increase of the developers.

According to the above first to fifth embodiments, the air take-in opening 51*a* and the air discharge 51*b* are disposed in such a way that the air flows in a direction perpendicular to the first rotation shaft 43*b*, so that it is possible to efficiently cool the first and third rotation shafts 43*b*, 20*a*, the first and third drive gears 55, 57.

Besides, according to the first to fifth embodiments, the air take-in opening 51*a* is disposed through the lower side of the housing box 51 and the air discharge opening 51*b* are disposed through the upper side of the housing box 51, so that the air flow which extends from the lower side of the housing box 51 to the upper side of the housing box 51 is efficiently formed; and it is possible to efficiently cool the first and third rotation shafts 43*b*, 20*a*, and the first and third drive gears 55, 57.

Besides, according to the above first to fifth embodiments, the first and third rotation shafts 43*b*, 20*a* and the first and third drive gears 55, 57 are formed of a relatively highly heat-conductive material, so that the heat generated at the bearing portions of the housing box 51 and at the respective mesh portions of the first and third drive gears 55, 57 diffuses to the entire bodies of the first and third rotation shafts 43*b*, 20*a* and of the first and third drive gears 55, 57; and the diffusing heat is radiated by the air flow due to the air discharge fan 65, so that it is possible to curb the temperature increase of the developers.

Besides, according to the above first to fifth embodiments, the air take-in opening 51*a* is disposed through the lower side (firs drive gear 55 side) of the housing box 51 and the air discharge opening 51*b* is disposed through the upper side (third drive gear 57 side) of the housing box 51; however, the present invention is not limited to this: a structure may be employed, in which the air take-in opening 51*a* is disposed through the upper side (third drive gear 57 side) of the housing box 51 and the air discharge opening 51*b* is disposed through the lower side (first drive gear 55 side) of the housing box 51. In this case as well, the same effects as in the above embodiments are obtained.

Besides, according to the above first to fifth embodiments, part of the wall surface of the housing box 51 is composed of the side wall 51*h*; however, the present invention is not limited to this: a structure may be employed, in which part of the wall surface of the housing box 51 is composed of a side wall of the development container 22 and bearings which rotatably support the drive gears 55 to 58 are formed on the side wall.

Besides, according to the above first to fifth embodiments, the present invention is applied to the structure which includes the development roller 20 and the magnetic roller 21; however, the present invention is not limited to this: the present invention may be applied to a structure in which the magnetic roller 21 is not disposed; the developers are directly supplied from the stir portion to the development roller.

The present invention is applicable to a development apparatus used for image forming apparatuses such as a copy machine, a printer, a facsimile, a multi-functional machine of them and the like and an image forming apparatus that uses the development apparatus, especially, to a development apparatus that is able to cool a drive portion and to an image forming apparatus that includes the development apparatus.

What is claimed is:

1. A development apparatus, comprising:

a stir member that stirs a developer in a development container;

a stir gear that rotates the stir member;

a stir rotation shaft that connects the stir member and the stir gear to each other;

a development member that supplies the developer onto a surface of an image carrier;

a development gear that collaborates with the stir gear to form a series of gears and rotates the development member;

a development rotation shaft that connects the development member and the development gear to each other;

a housing box that houses the stir gear and the development gear, supports rotatably the stir rotation shaft and the development rotation shaft, and is provided with an air take-in opening for taking in air and an air discharge opening for discharging the taken-in air; and a wind sending member that takes in the air from the air take-in opening into the housing box and makes the taken-in air pass through the housing box to discharge the air from the air discharge opening; wherein the air take-in, opening and the air discharge opening are disposed such that the air flows in a direction perpendicular to the stir rotation shaft, the air discharge opening is disposed at a position higher than the air take-in opening, the stir gear is disposed to oppose the air take-in opening; and air flowing into the housing box from the air take-in opening flows from the stir gear to the development gear.

2. The development apparatus according to claim 1, wherein the wind sending member is an air take-in fan and is disposed near the air take-in opening.

3. The development apparatus according to claim 1, wherein the wind sending member is an air discharge fan and is disposed near the air discharge opening.

4. The development apparatus according to claim 1, wherein the wind sending member is composed of an axial-flow fan.

5. The development apparatus according to claim 1, wherein the stir gear, the development gear, the stir rotation shaft and the development rotation shaft are composed of a heat conductive material.

6. The development apparatus according to claim 5, wherein a heat sink is provided on at least one rotation shaft of the stir rotation shaft and the development rotation shaft.

7. The development apparatus according to claim 6, wherein the heat sink is composed of a plurality of fans that extend radially from the rotation shaft.

8. The development apparatus according to claim 1, wherein the wind sending member is disposed on at least one rotation shaft of the stir rotation shaft and the development rotation shaft in the housing box.

9. The development apparatus according to claim 8, wherein the wind sending member is disposed on a rotation shaft disposed near the air take-in opening and is so disposed as to face the air take-in opening.

10. The development apparatus according to claim 9, wherein the wind sending member flows the air in a circumferential direction of the rotation shaft.

11. The development apparatus according to claim 9, wherein the wind sending member is composed of a sirocco fan.

12. An image forming apparatus comprising the development apparatus according to claim 1.

* * * * *